US011721309B1

(12) United States Patent
Gunderson

(10) Patent No.: US 11,721,309 B1
(45) Date of Patent: Aug. 8, 2023

(54) PIN TURNING TOOL KIT

(71) Applicant: John H Gunderson, Neptune City, NJ (US)

(72) Inventor: John H Gunderson, Neptune City, NJ (US)

( * ) Notice: Subject to any disclaimer, the term of this patent is extended or adjusted under 35 U.S.C. 154(b) by 0 days.

(21) Appl. No.: 18/307,479

(22) Filed: Apr. 26, 2023

Related U.S. Application Data

(60) Provisional application No. 63/363,799, filed on Apr. 28, 2022.

(51) Int. Cl.
*G10C 3/10* (2019.01)
*G10C 9/00* (2019.01)

(52) U.S. Cl.
CPC ..... *G10C 3/10* (2013.01)

(58) Field of Classification Search
CPC ..... G10C 3/10; G10C 9/00
See application file for complete search history.

(56) References Cited

U.S. PATENT DOCUMENTS 245,382 A * 8/1881 Jones ..... G10C 9/00 84/459
318,981 A * 6/1885 Green ..... G10C 9/00 84/459
342,051 A * 5/1886 Steets ..... G10C 9/00 84/459
360,871 A * 4/1887 Finney ..... G10C 9/00 84/459
RE10,946 E * 7/1888 Hale ..... 84/459
528,154 A * 10/1894 Fuchs ..... G10C 9/00 84/459
634,016 A * 10/1899 Mueller ..... G10C 9/00 84/459
768,447 A * 8/1904 Goodenow ..... G10C 9/00 84/459
777,281 A * 12/1904 Erlandsen ..... B23D 51/10 279/90
820,418 A * 5/1906 Hindman ..... G10C 9/00 84/459
834,468 A * 10/1906 Hale ..... G10C 9/00 84/459
842,307 A * 1/1907 Ellsworth ..... G10C 9/00 84/459
997,143 A * 7/1911 Lind ..... G10C 9/00 84/459
1,160,107 A * 11/1915 Hale ..... G10C 9/00 84/459

(Continued)

*Primary Examiner* — Robert W Horn

(57) ABSTRACT

A musical instrument tuning lever kit includes a handle with a first axis along its stem and a second axis defined by its grip, with an axial aperture at the distal end. A shaft component extending along a third axis, receivable within the aperture of the stem of the handle, includes means for attachment of a head component. The head has means for attachment to the shaft component at its first end and means for attachment of a tip component at its second end. The tip has a first end with means for attachment to the head component, and a second end with a socket extending along a fourth axis for turning a tuning pin of a musical instrument. The first and second axes define a first plane, the third axis of the shaft and fourth axis of the socket define a second plane angularly orientable to the handle plane.

22 Claims, 5 Drawing Sheets

(56) References Cited

U.S. PATENT DOCUMENTS

| | | | | | |
|---|---|---|---|---|---|
| 1,329,701 | A * | 2/1920 | Ellsworth | G10C 9/00 | 984/72 |
| 1,693,292 | A * | 11/1928 | Frauenberger | G10C 9/00 | 984/72 |
| 2,802,388 | A * | 8/1957 | Luckenbach | G10C 3/10 | 84/459 |
| 7,638,702 | B2 * | 12/2009 | Fujan | G10C 9/00 | 81/22 |
| 7,718,880 | B1 * | 5/2010 | Levitan | G10C 9/00 | 84/453 |
| 11,056,084 | B1 * | 7/2021 | Gunderson | G10C 3/106 | |
| 2006/0117934 | A1 * | 6/2006 | Fujan | G10C 9/00 | 84/459 |

* cited by examiner

C – C

D – D

PIN TURNING TOOL KIT

CROSS REFERENCE TO RELATED APPLICATIONS

This non-provisional patent application claims the benefit of and priority to U.S. Provisional patent application 63/363,799 "Pin Turning Tool Kit," filed 28 Apr. 2022. The entire contents of U.S. Provisional patent application 63/363,799 "Pin Turning Tool Kit," filed 28 Apr. 2022 are hereby incorporated into this document by reference. The entire contents of the inventor's patent application Ser. No. 17/228,574 "Pin Turning Tool Kit," filed Apr. 12, 2021 and which matured into U.S. Pat. No. 11,056,084 and issued Jul. 6, 2021 are also hereby incorporated into this document by reference. The application Ser. No. 17/228,574 "Pin Turning Tool Kit," filed Apr. 12, 2021 claims the benefit of and priority to U.S. Provisional patent application 63/012,799 "Pin Turning Tool Kit," filed 17 Apr. 2020. The contents of U.S. Provisional patent application 63/012,799 "Pin Turning Tool Kit," filed 17 Apr. 2020 are also hereby incorporated into this document by reference.

COPYRIGHT STATEMENT

A portion of the disclosure of this patent document contains material that is subject to copyright protection. The copyright owner has no objection to the facsimile reproduction by anyone of the patent document or the patent disclosure as it appears in the Patent and Trademark Office patent file or records, but otherwise reserves all copyright rights whatsoever.

FIELD

The invention relates to hand-held and hand-operated tools for gripping upon and turning pins while tuning pianos and other musical instruments or devices having tension-adjustable strings wherein at least one string end is wound around a rotatably adjustable pin.

BACKGROUND

Pianos are tuned using tools such as a lever with a handle at one end and a socket at another end, the socket having been made to engage the head of a tuning pin. Most commonly, these pins have square cross sections at their protruding ends, and in a piano ready for tuning the points of these square ends are oriented randomly from one pin to the next.

The tuning lever must align itself anew to the square head of each tuning pin and consequently the angle of a tuning lever's handle changes as the lever is moved from pin to pin. The result is that a piano tuner must contort his or her hand, wrist, arm, and shoulder to accommodate each new angle the tuning lever assumes as the entire piano is being tuned.

Considering that the average piano has some 230 tuning pins and the average full-time piano tuner may tune as many as three or four (or more) pianos a day, applying as much as 100 inch pounds of torque to each pin, it is understandable that the repetitive nature of this work may be stressful to a piano tuner's hand, wrist, arm, and shoulder, especially if working with a tool that lacks ergonomic design.

BRIEF DESCRIPTION

The invention is a lever for the purpose of tuning musical instruments in general and pianos especially. A primary objective of the invention is to provide a tool for tuning stringed musical instruments with an ergonomically designed handle for grasping by hand so that torque may be delivered to a tuning pin without having to contort one's hand, wrist, arm, or shoulder into awkward and uncomfortable positions which result when using a tuning lever with just a simple lever design.

Another objective of the invention is to provide a lever with a handle for grasping and applying effective torque to a musical instrument tuning pin. A corollary of this objective is to maximize the ease of use of the tool while minimizing stress and strain. Thus, by using the invention, the wrist gripping the handle remains within a comfortable, non-injurious range even while the position of the lever might be at an angle that a user could not grip comfortably while attempting to exert substantial torque on a tuning pin, and a user gripping and applying torque at such an extreme angle would likely incur pain and discomfort and also risk repetitive stress injury. This ability is even more advantageous when one considers the differences presented in tuning uprights, or vertically strung pianos, and grands, or horizontally strung pianos.

BRIEF DESCRIPTION OF THE DRAWINGS

A further understanding of the nature and advantages of the particular embodiments may be realized by reference to the remaining portions of the specification and the drawings, in which like reference numerals are used to refer to similar components. When reference is made to a reference numeral without specification to an existing sub-label, it is intended to refer to all such similar components.

DETAILED DESCRIPTION OF CERTAIN EMBODIMENTS

Figure 1A:
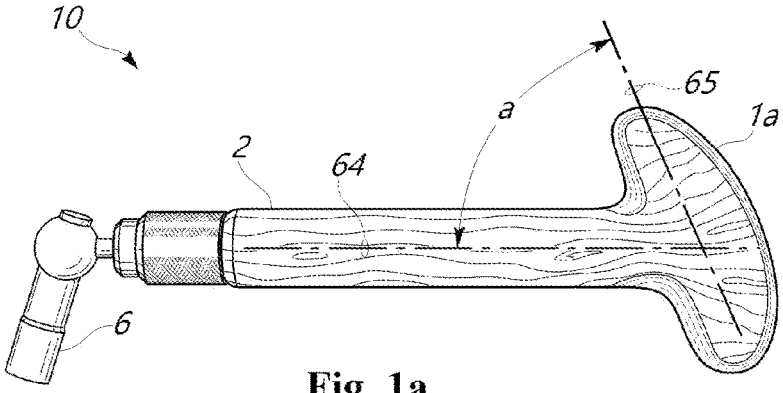
FIG. 1*a* shows an assembled pin turning tool incorporating a "crook" style handle in accordance with the invention.

While various aspects and features of certain embodiments have been summarized above, the following detailed description illustrates a few exemplary embodiments in further detail to enable one skilled in the art to practice such embodiments. The described examples are provided for illustrative purposes and are not intended to limit the scope of the invention.

In the following description, for the purposes of explanation, numerous specific details are set forth in order to provide a thorough understanding of the described embodiments. It will be apparent to one skilled in the art, however, that other embodiments of the present invention may be practiced without some of these specific details. Several embodiments are described herein and while various features are ascribed to different embodiments it should be appreciated that the features described with respect to one embodiment may be incorporated with other embodiments as well. By the same token, however, no single feature or features of any described embodiment should be considered essential to every embodiment of the invention, as other embodiments of the invention may omit such features.

In this application the use of the singular includes the plural unless specifically stated otherwise, and use of the terms "and" and "or" is equivalent to "and/or," also referred to as "non-exclusive or" unless otherwise indicated. Moreover, the use of the term "including," as well as other forms, such as "includes" and "included," should be considered non-exclusive. Also, terms such as "element" or "component" encompass both elements and components comprising one unit and elements and components that comprise more than one unit, unless specifically stated otherwise.

In this specification, the term "means for . . . " as used herein including the claims, is to be interpreted according to 35 USC 112 paragraph 6.

The use of the words "part," element," and "component" shall be interchangeable unless otherwise stated and the use of the words "tip" and "socket" shall have the same meaning unless otherwise stated and the use of the words "machine screw" and "set screw" shall also be interchangeable. The phrase "substantially perpendicular" is used to describe a condition in which a first entity extends in a direction within 15° of perpendicular with respect to a second entity, and "substantially parallel" similarly describes a condition in which a first entity extends in a direction within 15° of parallel with respect to a second entity.

Also in this specification a "piano tuner" is taken to mean a person who tunes pianos and not a machine, device, or tool for tuning pianos. A piano tuner and a "user" and a "tool user" and the like may be a person of any gender or sex. Grammatically gendered pronouns including but not limited to the pronouns "he," "she," "his," and "her" may apply interchangeably to any human person and in this specification masculine grammatical gender pronouns and markings may subsume their feminine equivalents. "They," "their," and "them" in this specification always indicate plural entities.

The word "handle" in this specification shall include any part of the invention that is designed for gripping by hand and any extension of material along an open or closed profile of any shape, size, or form, symmetrical or asymmetrical. For materials, the handle may include wood, plastic, polyamide, polycarbonate, urethane, acrylonitrile butadiene styrene (ABS,) acetal, polypropylene, polyester, polyvinyl chloride (PVC,) epoxy resin, brass, bronze, epoxy, aluminum, iron, steel, fiberglass, a composite material such as a material comprising a carbon fiber, or a metal alloy. Brand names or common names for some of these materials include Delrin® and nylon. Cross-linked polymers, monadic polymers, dyadic polymers such as 4,6, nylon and 6,6 nylon, and triadic polymers may also be used for components of the invention.

The invention is a kit of components which may be assembled into a musical instrument tuning tool acting as a lever for tuning musical instruments in general and pianos in particular. A musical instrument tuning lever in accordance with the invention is a lever with a first axis running longitudinally through its length. This part of the lever is referred to as its stem. At its distal end it has a means for attachment to a socket assembly designed to engage the head of a tuning pin and at its proximal end it has an ergonomically designed handle for gripping by hand; the handle having a second "grip axis" that intersects the lever's first axis. These two axes define a first plane, and a third axis which is coaxial with the first is defined by a shaft of a component rotatably adjustable around the lever's first axis.

The handle part of the musical instrument tuning tool kit in accordance with the invention may be a detachable from the stem part thereby allowing the handle part to be removed from the stem and replaced with other handles made to fit the stem.

The profile of the handle part at the lever incorporates two opposing horn-like protuberances extending out from the center of the lever's first axis along the lever's second or grip axis. These two opposing horn-like protuberances are joined at handle's proximal end by means of a gently curving surface the radius of which is compatible with the natural curve of the palm of a user's hand. The length, width, and thickness of the opposing horn-like protuberances are designed to fit comfortably inside the palm of a user's hand. The underside of each of the two protuberances incorporates a curving surface starting tangent to the lever's second, or gripping axis and ending tangent to the lever's first axis, the radius of which is so designed as to provide a comfortable place for a user's thumb thereby completing the handle's ergonomic grip.

The profile of the two opposing protuberances of the handle part of the lever may be symmetrical or asymmetrical and they may be centered on the lever's axis or offset to one side or the other of the lever's axis. The radius of the handle's upper-most proximal surface may be centered on the lever's axis or offset to one side or the other of the lever's axis.

The plane of the handle part of the lever may be set at any angle relative to the plane of the head and tip assembly as the head and tip assembly extends from the stem axis of the handle. By setting and resetting the angle of the plane of the handle relative to the plane of the head and tip assembly a user may customize the angle of the handle to a comfortable position for tuning.

The inventive tool lever thereby provides a user with a comfortable and ergonomic grip that may help alleviate the straining of tissues, tendons, and muscles and joints in the wrist, hand, arm, and shoulder commonly experienced by piano tuners which may result from having to contort one's hand, wrist, arm, and shoulder to follow the angle of a simple tuning lever as it is moved from tuning pin to tuning pin over the course of a piano tuning.

Although primarily directed at engaging tuning pins of a piano, the inventive tool kit may also be used for tuning other stringed instruments having taut strings wound around rotatable pins held by friction in anchor holes in the instrument's pin block or wrest plank. Harps, harpsichords, claviers, and spinets may also be tuned using the inventive tool.

FIG. 1*a* shows an pin turning tool [10] assembled from a kit of parts incorporating a "crook" style handle or lever in accordance with the invention to provide a handle which acts as a lever. The handle comprises first stem portion defining a first axis [64] running longitudinally through its center. At the distal end or stem portion [2] of the lever is a means for attachment of a socket assembly including a tip [6] designed to engage the head of a tuning pin. At the proximal end of the lever is an ergonomically designed grip portion [1*a*] with an axis that is rotatably adjustable around the center of the lever's first axis. Thus the first axis of the handle is coaxial and congruent to the first axis of the assembled tool. The tool is an assembly of components of the claimed tool kit.

A second axis [65] of the handle's grip is separate from the axis of the lever. By using this handle of the invention, the wrist gripping the handle remains within a comfortable, non-injurious range even while the position of the lever's first axis might be at an angle that a user could not grip comfortably while attempting to exert substantial torque on a tuning pin, and a user gripping and applying torque at such an extreme angle would likely incur pain and discomfort and also risk repetitive stress injury. This ability is even more advantageous when one considers the differences presented in tuning uprights, or vertically strung pianos, and grands, or horizontally strung pianos.

Although the first and second axes of the handle preferably do not meet perpendicularly, it is within the scope of the invention to fashion a perpendicular or "T-handle" version of the invention. In this embodiment for the "crook" handle, the angle [a] between the first and second axes of the handle is preferably within a range between about 92° and about 130° inclusively, within which an angle of about 95° is most preferred. An alternative embodiment is called a "paddle" style handle. In the paddle embodiment, the angle between the first and second axes of the handle is preferably within a range between about 50° and about 87° inclusively, within which an angle of about 70° is most preferred.

Figure 1B:
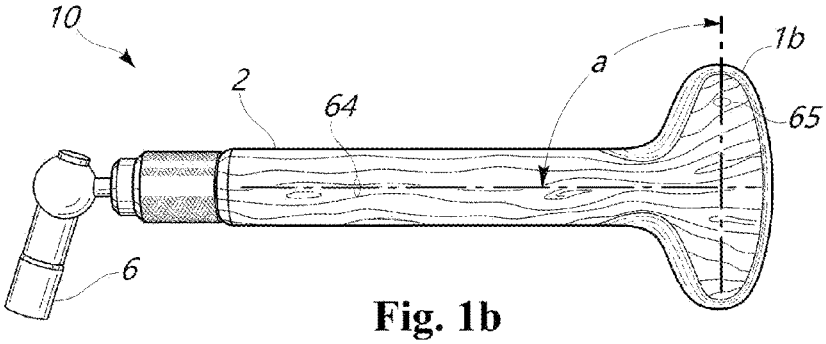
FIG. 1*b* shows an assembled pin turning tool incorporating a "paddle" style handle in accordance with the invention.

FIG. 1*b* shows an assembled pin turning tool [10] incorporating a handle [1*b*] in accordance with the invention wherein the second axis [65] is substantially perpendicular to the first axis [64.]

Figure 1C:
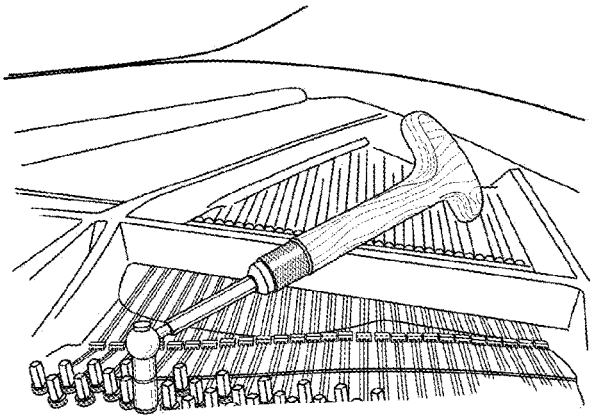
FIG. 1*c* shows the assembled pin turning tool kit of FIG. 1*a* in position on a grand piano, engaged on a piano string pin and ready for tuning.

FIG. 1*c* shows the assembled pin turning tool kit of FIG. 1*a* in accordance with the invention positioned on a pin of a piano.

Figure 1D:
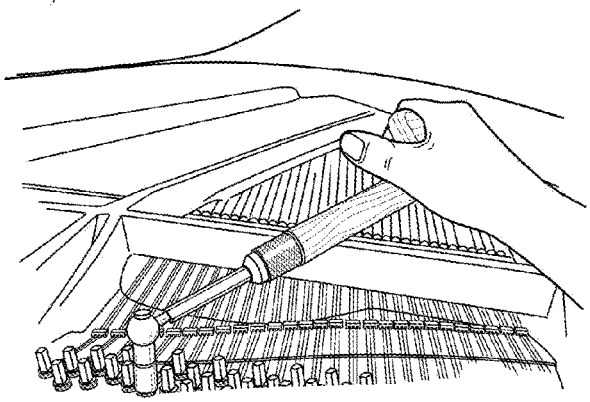
FIG. 1*d* shows a user's hand in an ergonomic, comfortable, and effective grip and ready to tune a piano string pin.

FIG. 1*d* shows a user's hand in an ergonomic, comfortable, and effective grip and ready to tune a piano string pin.

Figure 2A:
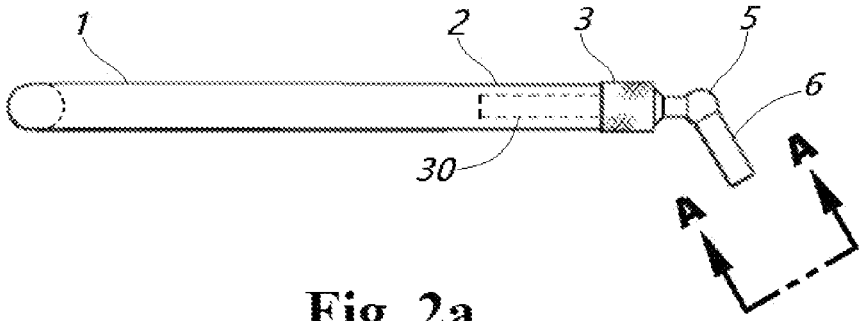
FIG. 2*a* shows a side view of the tuning tool kit in accordance with the invention, including a view line defining an auxiliary view A-A for FIG. 2*e*.
Figure 2B:
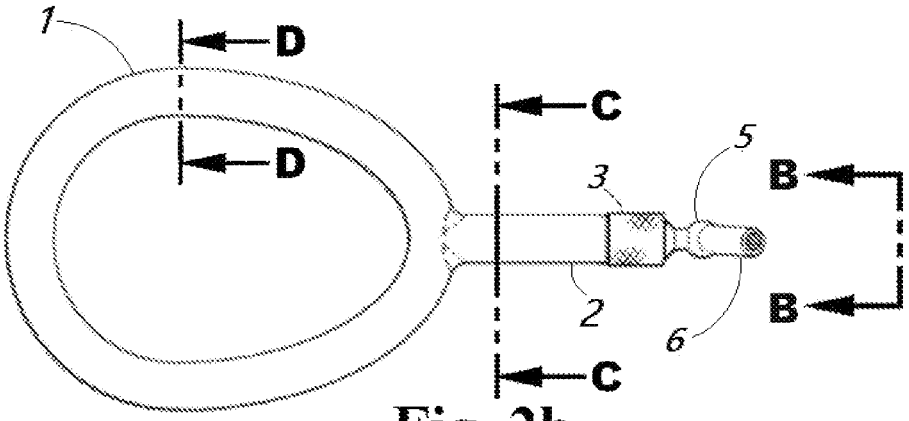
FIG. 2*b* shows a bottom view of a tool kit similar to that shown in FIG. 2*a*, including a view line defining an auxiliary view B-B for FIG. 2*g*, and defining section lines C-C for FIG. 2*c* and D-D for FIG. 2*d*.
Figure 2C:
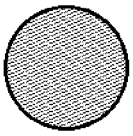
FIG. 2*c* shows a cross section of a shank portion of an optional embodiment of a tool handle taken at section line C-C defined in FIG. 2*b*.
Figure 2D:
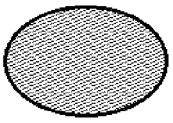
FIG. 2*d* shows a cross section of a grip portion of an optional embodiment of a tool handle taken at section line D-D defined in FIG. 2*b*.
Figure 2E:
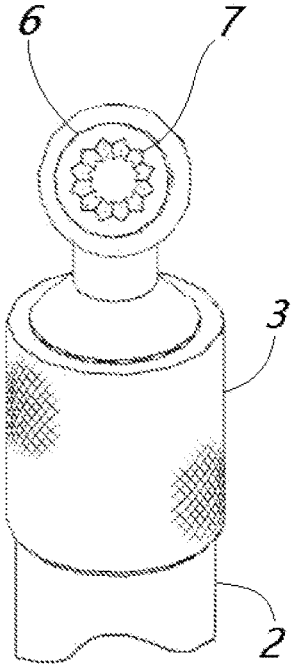
FIG. 2*e* is a view of the distal end of the tuning tool kit of FIG. 2*a* showing a tip component with a tuning pin engagement socket.
Figure 2F:
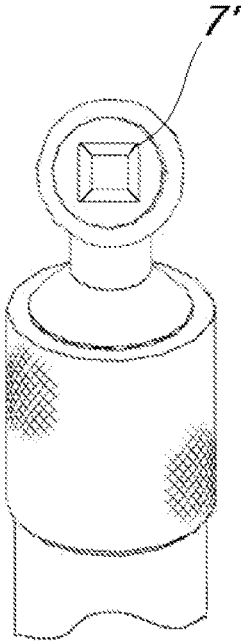
FIG. 2*f* is a view of the distal end of the tuning tool kit of FIG. 2*a* showing a tip component having an alternate tuning pin engagement socket.

FIG. 2*a* shows a side view of a tuning tool assembled from a kit of components in accordance with the invention, including a view line defining an auxiliary view A-A for FIGS. 2*e* and 2*f*. The tool has a handle with a grip portion [1] and a stem portion [2] with an aperture, a ferrule component [3,] a shaft component received within the aperture of the handle stem, a head component [5,] and a tip component [6.] In this embodiment the handle stem has a ferrule permanently mounted onto the stem at its distal end, and preferably coaxial with the handle stem axis. The head component is attached to the shaft component by means of complementary tapers on a frustum on the end of the shaft and a conical portion of an aperture in the head component as detailed in FIGS. 5*a*, 5*b*, and 6. Morse standard tapers are a best mode taper. The head and tip assembly is rotatable around the axis of the shaft and its angle with respect to a plane defined by the grip portion of the handle may be adjusted and fixed by a user of the invention.

FIG. 2*b* shows a bottom view of a tool kit similar to that shown in FIG. 2*a*. It includes a view line defining an auxiliary view B-B for FIG. 2*g* and section lines C-C for FIG. 2*c* and D-D for FIG. 2*d*. As seen in FIG. 2*a*, the handle has a grip portion [1] which is a loop, and a stem portion [2] extending from the loop to a distal end, a ferrule component [3,] a shaft component [30,] a head component [5,] and a tip component [6] which includes an aperture designed to fit onto and engage a tuning pin of an instrument.

FIG. 2*c* shows a cross section of a shank portion of an optional embodiment of a tool handle taken at section line C-C defined in FIG. 2*b*.

FIG. 2*d* shows a cross section of a grip portion of an optional embodiment of a tool handle taken at section line D-D defined in FIG. 2*b*. The grip portion of the tool handle may comprise a loop or other ergonomic or ornamental features. Cross sections of the shank or grip portion of the tool handle may be round, ovular, rectangular or of a polygonal cross-section, or of other effective or ornamental cross sections.

FIG. 2*e* shows the auxiliary view A-A of FIG. 2*a* which shows the distal portion [2] of the tuning tool, including the shaft component received by and emerging through the ferrule component [3,] and a tip component [6] with a first end with means for attachment to the head component, and a second end comprising a socket aperture [7] for engagement with a tuning pin.

FIG. 2*f* shows the auxiliary view A-A of FIG. 2*a* with the shaft component and the tip component having an alternative socket [7'] for engagement with a tuning pin.

Figure 2G:
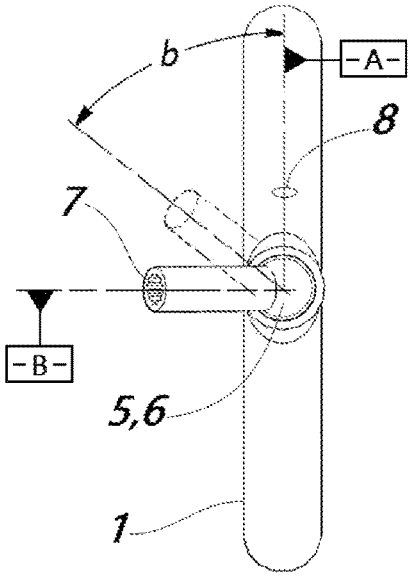
FIG. 2*g* shows the plane of the head and tip assembly of the tuning tool kit being adjustable with respect to the plane of the grip portion.

FIG. 2*g* shows the auxiliary view B-B which is a view looking at the distal end of the tool of FIG. 2*b*. It shows a grip portion [1] of the handle and a head component [5] and its tip component [6] assembled in accordance with the invention. The thickness of the grip portion of the handle defines a midplane [-A-] for the grip handle. The head and tip assembly and the angular orientation [b] of the head and tip assembly are adjustable with respect to the plane [-A-] defined by the grip, with the axis of the shaft component and the axis of the tip component defining an operating plane [-B-] which when in use also contains the rotational axis of the pin being turned. A user may set and lock the assembled tool with planes [-A-] and [-B-] angled to each other in any way comfortable to the gripping wrist of the user, or in orientations that fit well in confined spaces.

Figure 3:
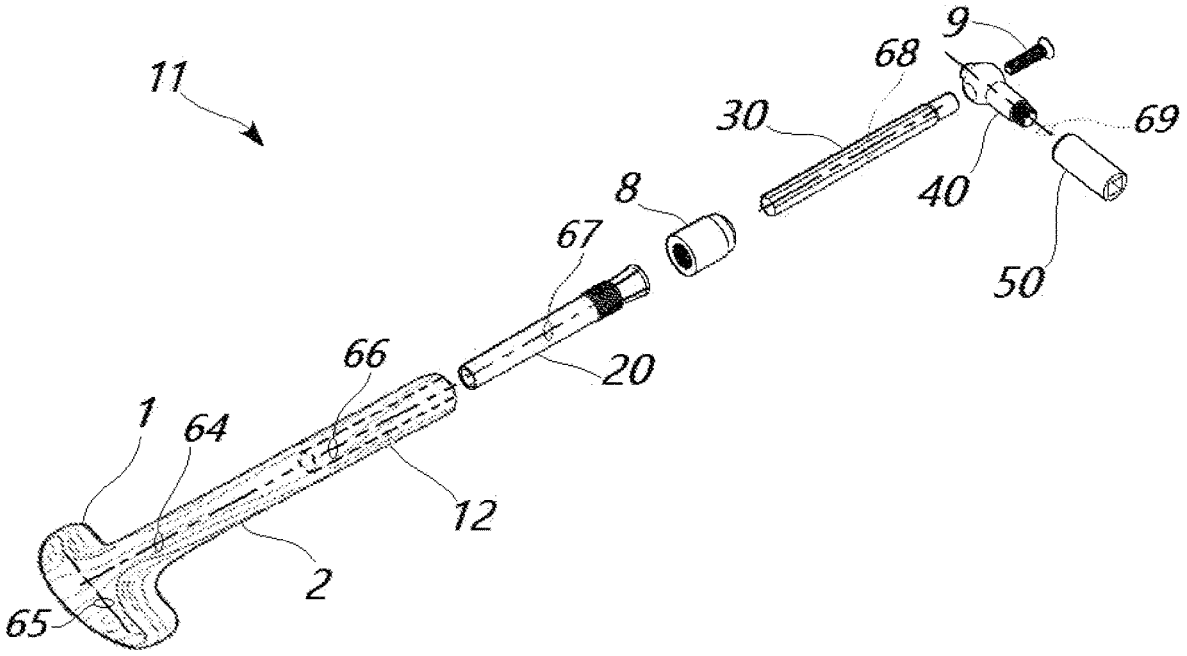
FIG. 3 shows an exploded view of an alternate embodiment of the tuning tool kit with a handle, a collet, a nut, a shaft, a head, and a tip.

FIG. 3 shows an exploded view of another alternate embodiment of the tool kit [11] in accordance with the invention. The kit comprises a handle with a grip portion [1] and a first stem portion [2] defining a first axis [64] extending from a distal end to a proximal end at an intersection of the first axis and a second axis [65] defined by a grip portion. An axially extending aperture [12] at the distal end has an axis [66] preferably but not necessarily coaxial with the first axis. The handle in this embodiment is a subassembly which includes a collet [20] and a ferrule component [8] for tightening the grips of the collet around an axially extendable shaft [30.]

The shaft component extends along a third axis [67] and is receivable within and through the ferrule component and then also receivable within the aperture of the stem portion of the handle in concert with the collet. The collet nut is threadably coupleable to the ferrule component. The shaft component includes means for attachment of a head component [40,] the head component having at a first end complementary means for attachment to the shaft component and at a second end means for attachment of a tip component [50.] The shaft cross sectional profile may be round, ovular, rectangular, or of a polygonal cross-section, or of other effective cross sections. The shaft component extends along a third axis [68] and includes means for attachment to a head component. The axis [48] of the tip component and the complementary attachment means of the head component is a fourth axis and with the third axis defines the operating plane [-B-] seen in FIG. 2*g*. The attachment means of this embodiment includes a threaded fastener [9] for locking the head and tip so that operating plane [-B-] may be at any convenient and effective angle with respect to the handle plane [-A-] seen in FIG. 2*g*.

Thus, the grip portion of the handle defines a first plane and the third axis of the shaft component with the fourth axis of the socket aperture define a second plane orientable at an angle to the first plane. Also, varying the distance between the handle and the tuning tip by extending and retracting the shaft from the stem provides a user with a means of adjusting the amount of leverage available for applying torque to a tuning pin.

The tip component has a first end comprising complementary means for attachment to the head component and a second end comprising a socket aperture extending along the fourth axis for engagement with a tuning pin. In this embodiment shown, the head component has male threads and the tip component has female threads on the end opposite the aperture configured to grip a tuning pin.

Figure 4:
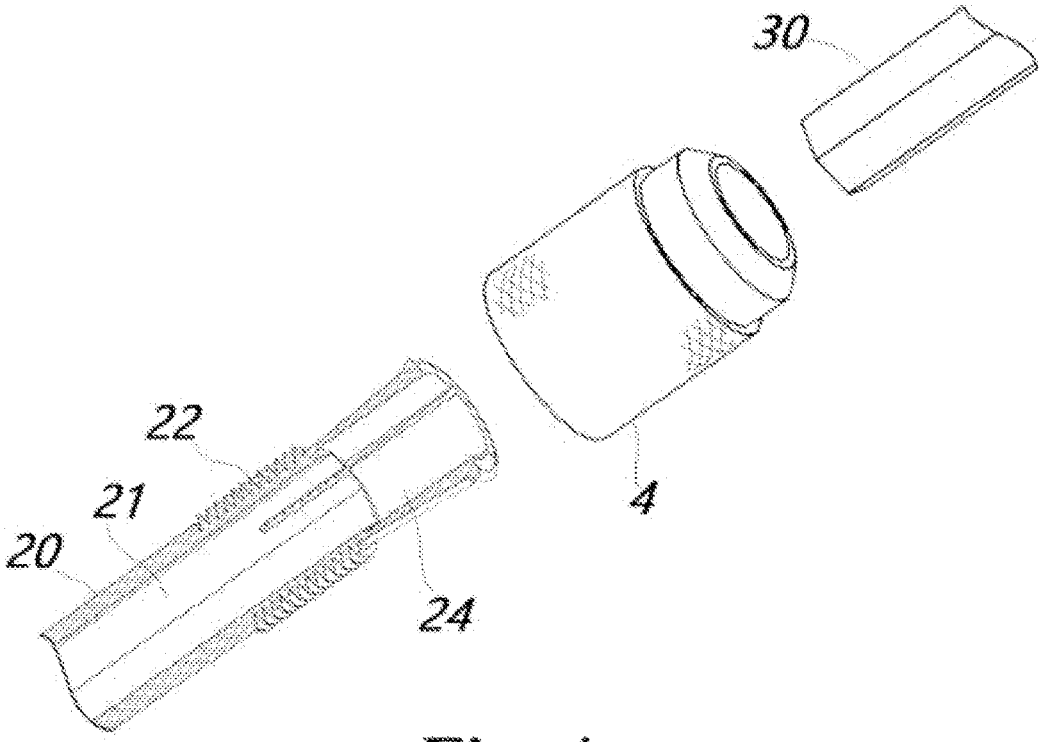
FIG. 4 shows a broken out view of a distal portion of a collet, a nut, and one end of a shaft component.

FIG. 4 shows a broken view of the distal end of a collet, a collet nut, and a hexagonal shaft in accordance with the invention. The collet [20] has threads [22] for receiving a nut. The collet also has an internal axial aperture [21] with at least a portion of its cross section being complementary to a shaft component. The collet includes a radially array of tangs [24] which are designed to close around a shaft component [30] as the collet nut [4] is tightened onto the collet, thereby locking the shaft at any point throughout its extension in and out of the stem. The ferrule component includes an aperture having a portion with a cross sectional profile complementary to the cross sectional profile of the shaft component. In this figure the shaft has a hexagonal cross section which is complementary to a hexagonal portion of the aperture in the distal portion of the ferrule.

Figure 5A:
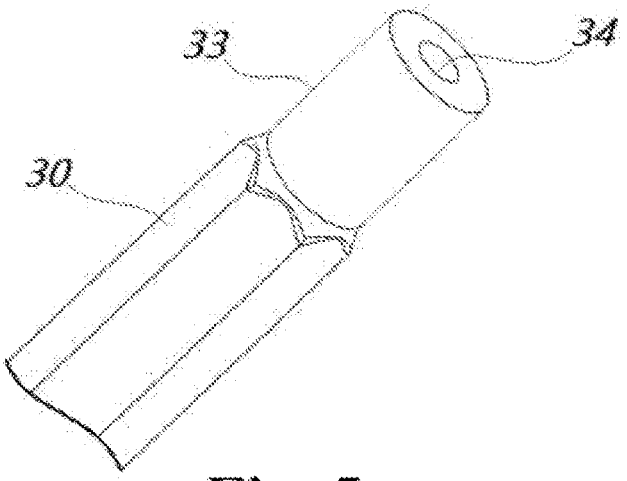
FIG. 5*a* shows a distal end of a shaft component.

FIG. 5*a* shows the distal end of a shaft component [30] in accordance with the invention. It shows a cylindrical surface [33] and a threaded bore [34] for receiving the threaded end of a set screw as means for attachment of the head component. In a best mode, the taper of the frustum is a Morse taper, and preferably but not necessarily, the frustum defines a second, longitudinal axis coaxial with the longitudinal axis of the shaft. Also preferably but not necessarily, the threaded bore in the shaft defines a longitudinal axis coaxial with the axis of the shaft.

Figure 5B:
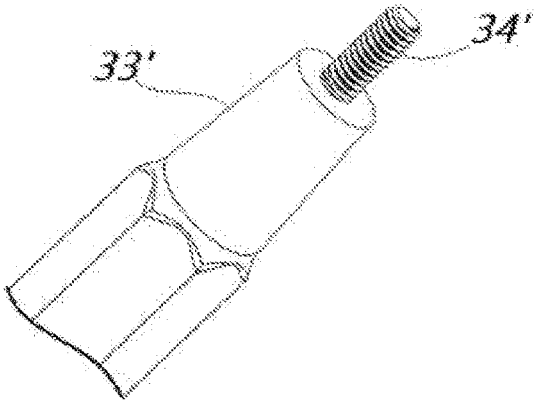
FIG. 5*b* shows a distal end of an alternative embodiment of a shaft component.

FIG. 5*b* shows a distal end of an alternative embodiment of a shaft component. The shaft component has an end which is received into a head component. The head component has at a first end complementary means for attachment to the shaft component and at a second end means for attachment of a tip component.

In this embodiment the shaft ends with a distal portion which is a frustum [33'] and the means for attachment at a first end of the head component comprises male threads, such as a threaded fastener like a set screw. The complementary means [34'] may include female threads in the head component or a threaded fastener having female threads which transfixes the head component and secures it to the shaft component, such as a hex nut or an internally threaded tube having a flange at one end larger than the smallest diameter of through-aperture passing through the head component.

Figure 6:
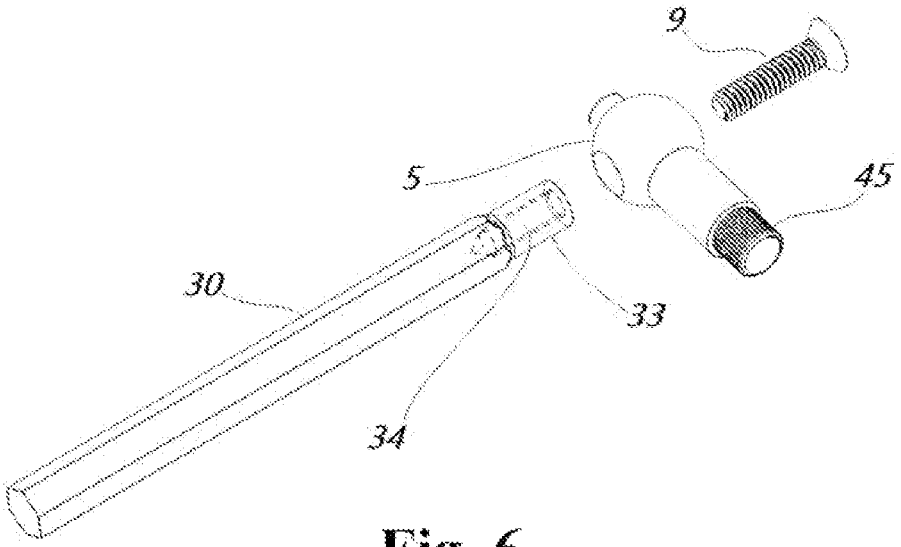
FIG. 6 shows an exploded view of some parts of the tool kit, including a head, a shaft, and a set screw ready for attachment to each other, with the shaft having a frustum, and the head having a complementary bore for mounting to the shaft and threads for attachment to a tip component.

FIG. 6 shows an exploded view of some of the kit parts, including a head component [5,] a shaft component [30,] and a set screw [9] ready for attachment to each other, with the shaft's frustum [33] having a threaded bore [34] for receiving the threaded end of a set screw, and the head component having a threaded end [45] for attachment of a tip component [50 of FIG. 3] which at its first end includes complementary means for attachment to the head component. The second end of the tip component includes a second end comprising a socket aperture extending along a fourth axis for engagement with a tuning pin. The set screw is a threaded fastener included in the kit, and the shaft component further comprises threading complementary to the threaded fastener. The head component is shown in further detail in FIG. 7. The complementary means may also include a Morse taper aperture into which a complementary Morse taper of the shaft is received.

Figure 7:
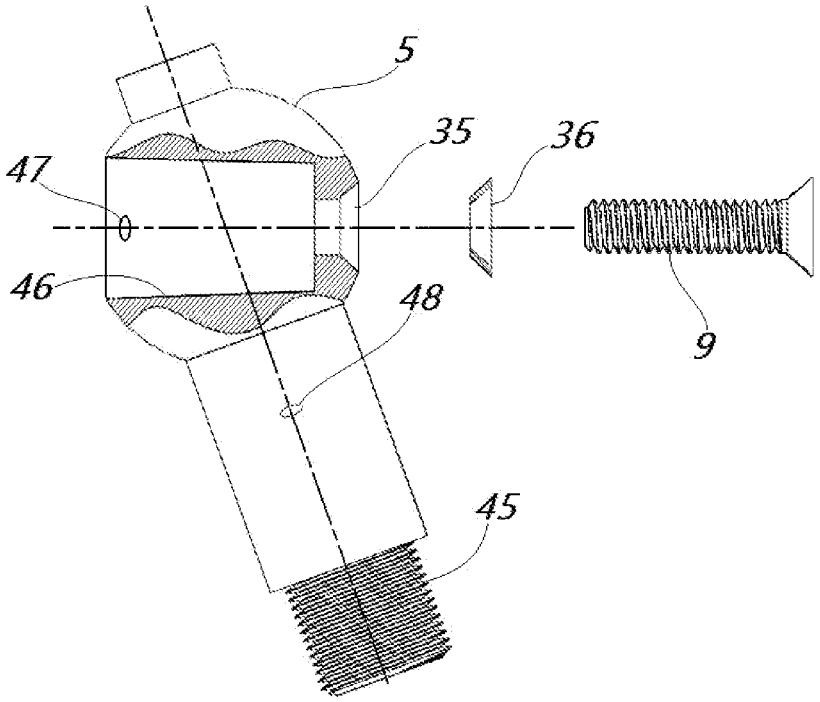
FIG. 7 shows a partial cross section view of a head component showing a first bore for attachment with a shaft component and a second bore for a set screw with the set screw positioned for entry through the second bore to engage the threaded bore of a shaft.

FIG. 7 shows a partial cross section of a head component [5] with its threaded end [45] which is a second end with means for attachment of a tip component [6 of FIG. 3.] The head component includes at a first end means of attachment to the shaft which in this embodiment is a first bore [46] tapered for receiving a frustum of a shaft which extends along an axis [47] to a depth which is a first length dimension and terminates inside the head, and a second bore opposite from and in line with the first bore extending into the head and penetrating the first bore at the center of its termination. The first and second bores meet to form a through-aperture having a second length dimension overall which is a less than the total length dimension of the through aperture, because the tapered bore with its a first length dimension is shorter than the total length dimension of the through aperture. The first bore includes an interior end wall [55] substantially perpendicular to its bore axis.

For embodiments wherein the shaft component has means for attachment which include a Morse taper as a frustum, the complementary means for attachment of the head component comprises a bore of a complementary Morse taper.

The second bore in the head component completes the through aperture and is sized to admit the set screw or other threaded fastener, and preferably includes a countersink [35] for receiving the set screw [9] which is also preferably countersunk. The axis of the tapered bore [46] is preferably coaxial with the axis of the shaft.

In assembly, the threaded end of a set screw is inserted through the second bore of a head as shown in FIG. 7 passing through the second bore into the first bore and then into the threaded bore of a shaft component onto which the head has been mounted. The set screw is then tightened into the threaded bore of the shaft, thereby pulling the head component tightly onto the shaft.

The threaded end of the head component is a second end which extends from the head along a fourth axis [48] which may reside perpendicular to the shared axis of the first and second bores of the head, or a head component may be fashioned with any other convenient threaded end angle to the shared axis of the first and second bores such that a set of interchangeable head components may be provided with the kit so that a user may select a most conveniently angled head component from among an assortment of kit parts. When installed onto the shaft, the third axis of the frustum of the shaft and the fourth axis of the second end of the head component define a plane of orientation for the head component. The socket aperture of the tip component extends along or parallel to this fourth axis. In an alternative and preferable embodiment, the pin turning tool kit includes a countersunk washer [36] interposed between a countersunk set screw and the through aperture with its countersink [35.]

Figure 8:
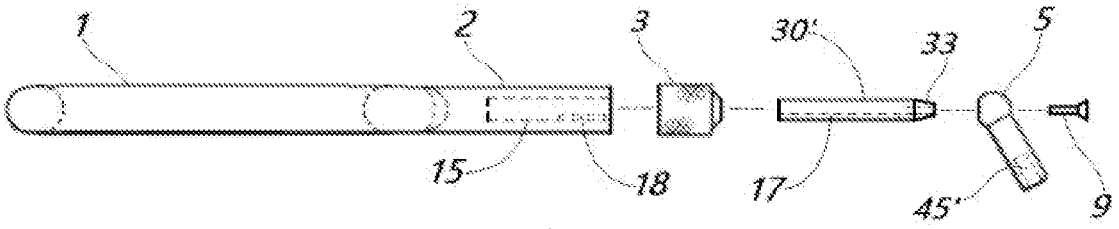
FIG. 8 shows an exploded view of yet another alternative tuning tool kit in accordance with the invention.

FIG. 8 shows an exploded view of yet another alternative tuning tool kit in accordance with the invention. The grip portion [1] and stem portion [2] of the handle are shown, with the stem including an aperture [15] for receiving the shaft [30'] which has a frustum [33] at one of its ends. In alternative embodiment, the distal rim of the frustum may include a fillet or a chamfer as a lead-in feature for fitting into the aperture of the head component. Thread locking compound may be applied to the distal threaded fastener to assist in holding the operating plane at a snug but slippable angle to the handle plane.

The shaft includes a frustum [33] at its distal end with a threaded bore centered on its end surface extending into the shaft coaxial with the axis of shaft for receiving a head and tip assembly [5.] The shaft in this embodiment may be extended and retracted in and out of the stem as well as being completely removable. Furthermore, the shaft may be locked at any position along its extension by tightening a collet nut or ferrule [3.]

The head component has a tapered bore complementary to the frustum and may be secured to the shaft by means of a screw [9.] A tip component as described elsewhere but having male threads may be threaded into the female threads [45'] of the projection of the head component. In this embodiment, the tip and the head are merged into a single component comprising a first end having a shaft portion receivable within the handle aperture and extending along a third axis, and a second end comprising a socket aperture extending along a fourth axis for engagement with a tuning pin.

On assembly the shaft is passed through a ferrule [3] with the shaft further comprising a keyway [17] which engages with a key [18] residing in the aperture in the stem portion of the handle. The shaft component cross section has a profile which may be a round profile, a round profile including a key way, an ovular profile, a rectangular profile, or a polygonal profile. The ferrule component comprises an aperture having a portion with a cross sectional profile complementary to the cross sectional profile of the shaft component, which prevents axial slipping or twisting during use.

The head and tip are thus extendable from the handle and may be secured by the collet nut at any desired distance from the handle. The third axis of the head is coaxial with the second axis of the handle.

While certain features and aspects have been described with respect to exemplary embodiments, one skilled in the art will recognize that numerous modifications are possible. Also, while certain functionality is ascribed to certain system components, unless the context dictates otherwise, this functionality may be distributed among various other system components in accordance with the several embodiments.

Moreover, while the procedures of the methods and processes described herein are described in a particular order for ease of description, unless the context dictates otherwise, various procedures may be reordered, added, and/or omitted in accordance with various embodiments. Furthermore, the procedures described with respect to one method or process may be incorporated within other described methods or processes; likewise, system components described according to a particular structural configuration and/or with respect to one system may be organized in alternative structural configurations and/or incorporated within other described systems.

The present disclosure is not to be limited in terms of the particular embodiments described in this application, which are intended as illustrations of various aspects. Many modifications and variations may be made without departing from its spirit and scope. Functionally equivalent methods and apparatuses within the scope of the disclosure, in addition to those enumerated herein, are possible from the foregoing descriptions. Such modifications and variations are intended to fall within the scope of the appended claims. The present disclosure is to be limited only by the terms of the appended claims, along with the full scope of equivalents to which such claims are entitled.

Hence, while various embodiments are described with or without certain features for ease of description and to illustrate exemplary aspects of those embodiments, the various components and/or features described herein with respect to a particular embodiment may be substituted, added, and/or subtracted from among other described embodiments, unless the context dictates otherwise. Thus, unauthorized instances of apparatuses and methods claimed herein are to be considered infringing, no matter where in the world they are advertised, sold, offered for sale, used, possessed, or performed.

Consequently and in summary, although many exemplary embodiments are described above, it will be appreciated that the invention is intended to cover all modifications and equivalents within the scope of the following claims.

What is claimed is:

1. A musical instrument tuning lever kit comprising a handle component further comprising a first stem portion defining a first axis extending from a distal end to a proximal end at an intersection of said first axis and a second axis defined by a grip portion, and an axially extending aperture at said distal end, a shaft component extending along a third axis and receivable within said aperture of said stem portion of said handle and having means for attachment of a head component, said head component having at a first end complementary means for attachment to said shaft component and at a second end means for attachment of a tip component, said tip component having a first end comprising complementary means for attachment to said head component, and a second end comprising a socket aperture extending along a fourth axis for engagement with a tuning pin.

2. The musical instrument tuning lever kit of claim 1, wherein said handle comprises a material selected from the set of materials consisting of wood, plastic, a polyamide, a polycarbonate, a urethane, an acrylonitrile butadiene styrene, a polypropylene, an acetal, a polyester, a polyvinyl chloride, an epoxy resin, brass, bronze, epoxy, iron, aluminum, steel, fiberglass, a composite material, a material comprising a carbon fiber, and a metal alloy.

3. The musical instrument tuning lever kit of claim 1, wherein said first axis intersects said second axis by an angle residing inclusively within 92° and 130°.

4. The musical instrument tuning lever kit of claim 1, wherein said shaft component comprises a cross sectional profile selected from a set of profiles consisting of:

a round profile, a round profile including a key way, an ovular profile, a rectangular profile, and a polygonal profile.

5. The musical instrument tuning lever kit of claim 1, wherein said shaft component comprises a frustum on its distal end.

6. The musical instrument tuning lever kit of claim 5, wherein said frustum comprises a Morse taper, and said complementary means for attachment of said head component comprises a complementary Morse taper.

7. The musical instrument tuning kit of claim 1, wherein said head component comprises a through-aperture having a tapered bore of a first length dimension shorter than a total length dimension of said through aperture.

8. The musical instrument tuning lever kit of claim 1, further comprising a threaded fastener, and said shaft component further comprises threading complementary to said threaded fastener.

9. The musical instrument tuning lever kit of claim 1, further comprising a countersunk washer interposed between said threaded fastener and said head component.

10. The musical instrument tuning lever kit of claim 1, wherein said first axis and said second axis define a first plane, and said third axis of said shaft component with said fourth axis of said socket aperture define a second plane orientable at an angle to said first plane.

11. A musical instrument tuning lever kit comprising a handle component comprising a first stem portion defining a first axis extending from a distal end to a proximal end at an intersection of said first axis and a second axis defined by a grip portion, and an axially extending aperture at said distal end, a ferrule component, a shaft component extending along a third axis and receivable within said ferrule component and having means for attachment of a head component, said head component further comprising a first end having complementary means for attachment to said shaft component and a second end comprising means for attachment of a tip component, said tip component further comprising a first end comprising complementary means for attachment to said head component and a second end comprising a socket aperture extending along a fourth axis for engagement with a tuning pin.

12. The musical instrument tuning lever kit of claim 11, further comprising a collet nut threadably coupleable to said ferrule component.

13. The musical instrument tuning lever kit of claim 11, wherein said handle comprises a material selected from the set of materials consisting of wood, plastic, a polyamide, a polycarbonate, a urethane, an acrylonitrile butadiene styrene, a polypropylene, an acetal, a polyester, a polyvinyl chloride, an epoxy resin, brass, bronze, epoxy, iron, aluminum, steel, fiberglass, a composite material, a material comprising a carbon fiber, and a metal alloy.

14. The musical instrument tuning lever kit of claim 11, wherein said first axis intersects said second axis by an angle residing inclusively within 50° and 87°.

15. The musical instrument tuning lever kit of claim 11, wherein said shaft component comprises a frustum on its distal end.

16. The musical instrument tuning lever kit of claim 15, wherein said frustum comprises a Morse taper, and said complementary means for attachment of said head component comprises a complementary Morse taper.

17. The musical instrument tuning kit of claim 11, wherein said head component comprises a through-aperture having a tapered bore of a first length dimension shorter than a total length dimension of said through aperture.

18. The musical instrument tuning lever kit of claim 11, wherein said shaft component comprises a cross sectional profile selected from a set of profiles consisting of:

a round profile, a round profile including a key way, an ovular profile, a rectangular profile, and a polygonal profile, and said ferrule component comprises an aperture having a portion with a cross sectional profile complementary to said cross sectional profile of said shaft component.

19. The musical instrument tuning lever kit of claim 11, further comprising a threaded fastener, and wherein said head component further comprises a through-aperture sized to admit said threaded fastener, and said shaft component further comprises threading complementary to said threaded fastener.

20. The musical instrument tuning lever kit of claim 19, further comprising a countersunk washer interposed between said threaded fastener and said head component.

21. The musical instrument tuning lever kit of claim 11, wherein said first and second axes of said handle defines a first plane, and said third axis of said shaft component with said fourth axis of said socket aperture define a second plane orientable at an angle to said first plane.

22. A musical instrument tuning lever assembly, comprising a handle component further comprising a first stem portion defining a first axis extending from a distal end to a proximal end at an intersection of said first axis and a second axis defined by a grip portion, and an axially extending aperture at said distal end, a tip component comprising a first end having a shaft portion receivable within said handle aperture and extending along a third axis, and a second end comprising a socket aperture extending along a fourth axis for engagement with a tuning pin, whereby said first and second axis define a first plane, and said third and fourth axis of said tip component socket aperture define a second plane orientable at an angle to said first plane.

* * * * *